US012600389B2

(12) United States Patent
Zeilinger et al.

(10) Patent No.: US 12,600,389 B2
(45) Date of Patent: Apr. 14, 2026

(54) METHOD FOR MONITORING A RAILWAY TRACK AND MONITORING SYSTEM FOR MONITORING A RAILWAY TRACK

(71) Applicant: Sensonic GmbH, Schärding (AT)

(72) Inventors: Rene Zeilinger, St. Florian am Inn (AT); Stefan Huber, Perlesreut (DE); Richard Deetlefs, Rainbach im Innkreis (AT); Roman Milleder, Zell an der Pram (AT); Andreas Ebertseder, Ruhstorf (DE)

(73) Assignee: Sensonic GmbH, Schärding (AT)

( * ) Notice: Subject to any disclaimer, the term of this patent is extended or adjusted under 35 U.S.C. 154(b) by 707 days.

(21) Appl. No.: 18/010,797

(22) PCT Filed: Jun. 14, 2021

(86) PCT No.: PCT/EP2021/065927
§ 371 (c)(1),
(2) Date: Dec. 15, 2022

(87) PCT Pub. No.: WO2021/254947
PCT Pub. Date: Dec. 23, 2021

(65) Prior Publication Data

US 2023/0339524 A1 Oct. 26, 2023

(30) Foreign Application Priority Data

Jun. 16, 2020 (EP) ..... 20180357

(51) Int. Cl.
*B61L 1/06* (2006.01)
*B61L 1/16* (2006.01)
(Continued)

(52) U.S. Cl.
CPC ..... *B61L 1/06* (2013.01); *B61L 1/166* (2013.01); *B61L 25/02* (2013.01); *B61L 25/021* (2013.01); *B61L 27/57* (2022.01)

(58) Field of Classification Search
CPC .. B61L 1/166; B61L 1/06; B61L 23/04; B61L 25/02; B61L 27/57; B61L 1/163; B61L 25/021
See application file for complete search history.

(56) References Cited

U.S. PATENT DOCUMENTS 9,457,819 B2 * 10/2016 Ernst ..... B61L 25/025
9,714,043 B2 * 7/2017 Mian ..... G01H 1/00
(Continued)

FOREIGN PATENT DOCUMENTS

CN 105658499 A 6/2016
DE 102010013312 A1 9/2011
(Continued)

OTHER PUBLICATIONS

Australian Office Action for Application No. 2021290913, dated Jun. 26, 2023, 2 pages.
(Continued)

*Primary Examiner* — Cheng Lin
(74) *Attorney, Agent, or Firm* — Morgan, Lewis & Bockius LLP

(57) ABSTRACT

A method for monitoring a railway track (11) is provided, the method comprising detecting monitoring signals (MS) by a distributed acoustic sensor (10) being arranged along the track (11), where each monitoring signal (MS) comprises a monitoring signal value (MSV) for a first measurement segment (12) of the distributed acoustic sensor (10) and a monitoring signal value (MSV) for a second measurement segment (22) of the distributed acoustic sensor (10), determining a first event monitoring signal value (EV1) for the
(Continued)

first measurement segment (12) from the monitoring signal values (MSV) that are detected during the passage of a rail vehicle over the position of the first measurement segment (12), determining a second event monitoring signal value (EV2) for the second measurement segment (22) from the monitoring signal values (MSV) that are detected during the passage of a rail vehicle over the position of the second measurement segment (22), and determining a difference value (DV) where the difference value (DV) relates to the difference between an average relative value (ARV) and a relative value (RV), where the relative value (RV) is given by the relative difference between the first event monitoring signal value (EV1) and the second event monitoring signal value (EV2), wherein the average relative value (ARV) relates to an average value of relative values (RV) determined from previous passages of rail vehicles. Furthermore, a monitoring system (15) for monitoring a railway track (11) is provided.

15 Claims, 4 Drawing Sheets

(51) Int. Cl.
*B61L 25/02* (2006.01)
*B61L 27/57* (2022.01)

(56) References Cited

U.S. PATENT DOCUMENTS

| | | | | |
|---|---|---|---|---|
| 10,513,279 | B2 * | 12/2019 | Mulligan | B61L 27/53 |
| 10,513,280 | B2 * | 12/2019 | Mian | B61L 3/02 |
| 10,614,708 | B1 * | 4/2020 | Cooper | B61L 1/166 |
| 10,940,876 | B2 * | 3/2021 | Agrawal | B61L 15/0081 |
| 2015/0000415 | A1 * | 1/2015 | Kelley | B61L 5/206 73/649 |
| 2015/0013465 | A1 * | 1/2015 | Godfrey | B61L 23/045 73/655 |

FOREIGN PATENT DOCUMENTS

| | | | | |
|---|---|---|---|---|
| DE | 102012213487 | A1 * | 2/2014 | B61L 1/04 |
| EP | 3531078 | A1 * | 8/2019 | B61L 23/044 |
| GB | 201203273 | | 4/2012 | |
| WO | 2013/124681 | A2 | 8/2013 | |
| WO | WO-2013114129 | A1 * | 8/2013 | B61L 1/14 |
| WO | WO-2013114135 | A2 * | 8/2013 | B61L 27/40 |
| WO | 2014/019889 | A2 | 2/2014 | |
| WO | WO-2017197423 | A1 | 11/2017 | |
| WO | WO-2018015164 | A1 * | 1/2018 | B60T 17/228 |
| WO | 2018/211237 | A1 | 11/2018 | |

OTHER PUBLICATIONS

Indian Office Action for Application No. 202227077220, dated Mar. 3, 2023, 7 pages.
Chinese Office Action in Application No. 202180042825.8, dated Jun. 13, 2024, 10 pages including translation.
Chinese Search Report in Application No. 202180042825.8, dated Jun. 11, 2024, 3 pages.
International Search Report for Application No. PCT/EP2021/065927, dated Aug. 17, 2021, 3 pages.
European Search Report for Application No. 20180357.4, dated Dec. 7, 2020, 8 pages.

* cited by examiner

METHOD FOR MONITORING A RAILWAY TRACK AND MONITORING SYSTEM FOR MONITORING A RAILWAY TRACK

A method for monitoring a railway track and a monitoring system for monitoring a railway track are provided.

Distributed acoustic sensing can be employed in railway monitoring. For this purpose a laser pulse is fed into an optical fibre extending along the railway track. By analyzing the backscattered signal noise on and around the railway track can be detected. From the shape of the backscattered signal passing rail vehicles can be distinguished from other noise. The backscattered signal can be employed to determine different parameters of the movement of the rail vehicles. For example the velocity or the position of the rail vehicles can be determined.

It is however not in all cases possible to determine directly from the backscattered signal on which track in the case of several tracks running parallel to each other a rail vehicle is moving or if the railway track has a defect. The extraction of these parameters from the backscattered signals could improve the accuracy of monitoring rail vehicle infrastructure.

It is an objective to provide a method for monitoring a railway track with an improved accuracy. It is further an objective to provide a monitoring system for monitoring a railway track with an improved accuracy.

These objectives are achieved with the independent claims. Further embodiments are the subject of dependent claims.

According to at least one embodiment of the method for monitoring a railway track, the method comprises the step of detecting monitoring signals by a distributed acoustic sensor being arranged along the track, where each monitoring signal comprises a monitoring signal value for a first measurement segment of the distributed acoustic sensor and a monitoring signal value for a second measurement segment of the distributed acoustic sensor. The distributed acoustic sensor can be arranged in the environment of the railway track. This means, the distributed acoustic sensor can be arranged close to the railway track. The distributed acoustic sensor can further extend along the railway track. The length of the distributed acoustic sensor can amount to several kilometers or several hundreds of kilometers. The distributed acoustic sensor is divided into a plurality of measurement segments. The first measurement segment and the second measurement segment are each one of the plurality of measurement segments. Each measurement segment corresponds to a predefined length along the distributed acoustic sensor. This means, each measurement segment directly adjoins another measurement segment. The measurement segments can all have the same length. For example the measurement segments each have a length of a few meters, for example less than 10 m. Each monitoring signal comprises a plurality of monitoring signal values, where each monitoring signal value relates to a measurement value detected by the distributed acoustic sensor in the respective measurement segment. The method can comprise detecting several monitoring signals after one another. This means, two monitoring signals can differ from each other in the time at which they are detected.

The method further comprises determining a first event monitoring signal value for the first measurement segment from the monitoring signal values that are detected during the passage of a rail vehicle over the position of the first measurement segment. During the passage of one rail vehicle several monitoring signal values are detected for the first measurement segment. This means, the monitoring signal values are detected with a predefined frequency. The predefined frequency is typically higher than 1 Hz so that the duration of a passage of a rail vehicle is longer than one period of the predefined frequency. For determining the first event monitoring signal value only the monitoring signal values that are detected during the passage of one rail vehicle at the position of the first measurement segment are taken into account. From the shape of the monitoring signal detected by the distributed acoustic sensor it can be determined at which position on the railway track a rail vehicle is moving. From this information it is determined which monitoring signal values are taken into account for determining the first event monitoring signal value. Each first event monitoring signal value relates to the passage of only one rail vehicle.

The method further comprises determining a second event monitoring signal value for the second measurement segment from the monitoring signal values that are detected during the passage of a rail vehicle over the position of the second measurement segment. During the passage of one rail vehicle several monitoring signal values are detected for the second measurement segment. This means, the monitoring signal values are detected with a predefined frequency. The predefined frequency is typically higher than 1 Hz so that the duration of a passage of a rail vehicle is longer than one period of the predefined frequency. For determining the second event monitoring signal value only the monitoring signal values that are detected during the passage of one rail vehicle at the position of the second measurement segment are taken into account. From the shape of the monitoring signal detected by the distributed acoustic sensor it can be determined at which position on the railway track a rail vehicle is moving. From this information it is determined which monitoring signal values are taken into account for determining the second event monitoring signal value. Each second event monitoring signal value relates to the passage of only one rail vehicle.

Each first event monitoring signal value and each second event monitoring signal value provides a measure for the energy provided by the passing rail vehicle at the position of the respective measurement segment and passed to the distributed acoustic sensor. Thus, each first event monitoring signal value and each second event monitoring signal value depends on the distance between the distributed acoustic sensor and the railway track, on the transfer properties of the ground between the distributed acoustic sensor and the railway track at the position of the respective measurement segment and on properties of the respective rail vehicle, such as its weight and velocity.

The method further comprises determining a difference value where the difference value relates to the difference between an average relative value and a relative value, where the relative value is given by the relative difference between the first event monitoring signal value and the second event monitoring signal value, wherein the average relative value relates to an average value of relative values determined from previous passages of rail vehicles. For the first and the second measurement segment an average relative value can be stored in a database or a storage unit, respectively. The entirety of all average relative values for all measurement segments of a railway track is referred to as the fingerprint of the respective railway track. It is thus possible that several railway tracks are arranged next to each other. For more than one railway track being arranged next to each other each railway track has its own fingerprint. The first measurement segment and the second measurement segment can be spaced apart from each other. This means, the first measurement segment and the second measurement segment are not necessarily direct neighbors. For example, a plurality of further measurement segments is arranged between the first measurement segment and the second measurement segment. For example, at least ten further measurement segments are arranged between the first measurement segment and the second measurement segment. This arrangement improves the accuracy of the method.

The relative values determined from previous passages of rail vehicles are detected before the monitoring signal values are detected. The relative values determined from previous passages of rail vehicles can be detected during a calibration phase. The relative values determined from previous passages of rail vehicles are determined in the same way as the relative values. To determine the average relative value an average of relative values determined from previous passages of rail vehicles is determined. The average relative can be given by the average of at least 10 relative values or at least 100 relative values. Alternatively, taking only one train into consideration, instead of statistics, thresholds can be used to identify whether the train is within these relative values. Each of the relative values determined from previous passages of rail vehicles relates to the passage of one rail vehicle on the track. The rail vehicles can be different rail vehicles moving with different velocities.

The method can further comprise providing an output signal comprising the difference value. The difference value can be employed to provide warning signals in case of irregularities.

A signal detected by a distributed acoustic sensor does not comprise the information on which track out of several tracks a rail vehicle is moving. Furthermore, from only one signal detected by a distributed acoustic sensor no detailed information about the condition of the track can be derived. Therefore, the method provided herein is concerned with improved monitoring of a railway track by employing a distributed acoustic sensor.

According to the provided method, at first, initial monitoring signals are detected. The initial monitoring signals are monitoring signals determined from previous passages of rail vehicles. Each initial monitoring signal comprises a plurality of initial monitoring signal values. The initial monitoring signals are detected during the passage of a plurality of rail vehicles on the track along which the distributed acoustic sensor arranged. The initial monitoring signals are detected for the first measurement segment and for the second measurement segment. The rail vehicles can be different rail vehicles and they can move with different velocities. From the initial monitoring signal values of the first measurement segment first event monitoring signal values are determined for the passage different rail vehicles. Furthermore, from the initial monitoring signal values of the second measurement segment second event monitoring signal values are determined for the passage of the same rail vehicles as for the first measurement segment. For the passage of each rail vehicle a relative value is determined as the relative difference between the first event monitoring signal value and the second event monitoring signal value. This means, a plurality of relative values is determined. The average relative value is the average of these relative values. The average relative value corresponds to an average response of the distributed acoustic sensor to a plurality of rail vehicles. The average relative value can be determined for all measurement segments of the distributed acoustic sensor. In this case, all average relative values together form the fingerprint for one railway track. The fingerprint has a specific shape for each track. The fingerprint relates to the sum of all vibrations caused by passing rail vehicles. It is influenced by the shape of the rails and the surroundings of the track. The shape of the fingerprint further depends on the distance between the distributed acoustic sensor and the track for the different measurement segments.

In a second step of the method monitoring signals each comprising a plurality of monitoring signal values are detected for the first measurement segment and for the second measurement segment. This means, the monitoring signals are detected in the same way as the initial monitoring signals. For the first measurement segment the first event monitoring signal value is determined from the monitoring signal values that are detected during the passage of a rail vehicle over the position of the first measurement segment. For the second measurement segment the second event monitoring signal value is determined from the monitoring signal values that are detected during the passage of a rail vehicle over the position of the second measurement segment.

In a next step the average relative value is compared to the relative value. The relative value is the relative difference between the first event monitoring signal value and the second event monitoring signal value. This means, the difference value is determined. These steps can be carried out for a plurality of pairs of measurement segments. This means, the difference value can be determined for a plurality of measurement segments of the distributed acoustic sensor. It is possible to determine the difference value for the first measurement segment and a plurality of other measurement segments. It is further possible to determine the difference value for different pairs of measurement segments. Each difference value is determined from monitoring signal values from two measurement segments. These two measurement segments can be the first measurement segment and the second measurement segment. It is further possible that these two measurement segments are the first measurement segment and one other measurement segment than the second measurement segment.

It is advantageous to determine the relative differences and compare these values with each other. Both the average relative value and the relative value are determined from relative differences. Deviations in the monitoring signal values due to different velocities or weights of rail vehicles are not taken into account in the relative differences. Therefore, a comparison of relative values with average relative values is more meaningful. If a passing rail vehicle and the track on which the rail vehicle is moving are both intact, the difference value will be small. This means, the relative value is approximately the same as the average relative value. For undisturbed and intact conditions the relative values for the measurement segments of the distributed acoustic sensor have approximately the same value as the fingerprint. However, the amplitude of the monitoring signal values can vary because of the velocity or the weight of a rail vehicle. For not taking into account these variations only relative differences are compared.

From the difference value certain conditions of the track or the rail vehicle can be determined. For example, small difference values relate to the rail vehicle being on the track. Larger difference values over longer distances can relate to the rail vehicle being on another parallel track. Larger difference values at certain positions along the railway track can relate to defects or changes of the railway track. These defects or changes can be detected immediately when a rail vehicle has passed the respective position. This allows a fast repair or investigation which improves the overall safety.

Consequently, the method described herein enables monitoring of a railway track and determining different conditions of the rail vehicle and the railway track. Therefore, the accuracy of monitoring is improved.

According to at least one embodiment of the method, the method comprises determining for each measurement segment the difference value for the respective measurement segment and a plurality of other measurement segments. This means, for each measurement segment, pairs of this measurement segment and one other measurement segment are formed, respectively. For each pair the step of determining the difference value is carried out. It is advantageous to determine the difference value for pairs of one measurement segment and one of a plurality of other measurement segments. This improves the accuracy of determining the difference value.

According to at least one embodiment of the method the distributed acoustic sensor comprises an optical fibre arranged along the track and the monitoring signals are backscattered signals of an input signal which is provided to the optical fibre. The optical fibre can be arranged within the ground close to the railway track. It is further possible that the optical fibre is arranged above the ground close to the railway track. The optical fibre extends approximately parallel to the railway track. The input signal can be an optical signal, for example a laser pulse. The input signal is provided to the optical fibre at an input of the optical fibre. A small part of the laser light is reflected back to the input since the laser light is scattered at scatter sites, as for example impurities in the optical fibre which can be natural or artificial. Changes in the backscattered signal are related to physical changes in the optical fibre which can be caused by noise, structure-borne noise, vibrations or soundwaves along the optical fibre. Therefore, a backscattered signal can be detected when a rail vehicle is moving on the track. Each monitoring signal is a backscattered signal of one input signal. By evaluating the backscattered signal, the location of the noise or the rail vehicle along the optical fibre can be determined. The monitoring signals can be analyzed in different ways. Thus, rail vehicles moving on the track can be monitored.

According to at least one embodiment of the method an upper threshold value is given by the product of the variance of the average relative value and a k-value, and it is determined if the difference value exceeds the upper threshold value. The variance of the average relative value is the standard deviation of the average relative value. The k-value can be a predefined constant. This means, the k-value is a scaling factor for the upper threshold value. The upper threshold value can be a measure for how much the relative value typically deviates from the average relative value. If the difference value exceeds the upper threshold value the relative value is not in the expected range. In this case a warning signal can be provided. The upper threshold value can be different for each measurement segment. The situation that the difference value exceeds the upper threshold value can be caused by a defect of the rail or the rail vehicle, or other changes at the rail or the rail vehicle. By determining the upper threshold value it is possible to monitor rail vehicles on the track with an improved accuracy as deviations from a typical behavior are detected.

Instead of the variance, the standard deviation can be used for determining the upper threshold value.

In case of only one train, the variance and/or standard deviation is 1, thus the upper threshold value is equal to the k-value.

According to at least one embodiment of the method a lower threshold value is given by the product of the variance of the average relative value and an l-value, and it is determined if the difference value is below the lower threshold value. The variance of the average relative value is the standard deviation of the average relative value. The l-value can be a predefined constant. This means, the l-value is a scaling factor for the lower threshold value. The lower threshold value can be a measure for how much the relative value typically deviates from the average relative value. If the difference value is below the lower threshold value the relative value is not in the expected range. In this case a warning signal can be provided. The lower threshold value can be different for each measurement segment. The situation that the difference value is below the lower threshold value can be caused by a defect of the rail or the rail vehicle, or other changes at the rail or the rail vehicle. By determining the lower threshold value it is possible to monitor rail vehicles on the track with an improved accuracy as deviations from a typical behavior are detected.

Instead of the variance, the standard deviation can be used for determining the lower threshold value.

In case of only one train, the variance and/or standard deviation is 1, thus the lower threshold value is equal to the l-value.

Deviations of the relative value from the average relative value can relate to different situations. For example, if the difference value exceeds the upper threshold value a defect can be present at the rail. In this case, the difference value only exceeds the upper threshold value for a limited number of measurement segments. If a rail has a defect more energy is emitted by a passing rail vehicle at the position of the defect, for example because of increased friction. Therefore, the monitoring signal values have a higher amplitude at the position of a defect at or of the rail. Consequently, for this position the difference value is larger. As a defect at or of the rail usually does not extend over long distances but is very localized only a few measurement segments will show an increased difference value. If the difference value deviates from its expected value for a large number of measurement segments this can be caused by wear or tear of the rail. Thus, from analyzing the difference value it is possible to locate defects or other changes at or of the rail.

According to at least one embodiment of the method the first measurement segment and the second measurement segment each relate to a predefined distance along the distributed acoustic sensor. The distributed acoustic sensor is divided into a plurality of measurement segments. Each of the measurement segments can have the same length along the distributed acoustic sensor. The measurement segments directly follow after one another. The length of a measurement segment can relate to the resolution of the backscattered signal along the optical fibre. Thus, each measurement segment, also the first measurement segment and the second measurement segment, relates to one data point in the backscattered signal. A small length of the measurement segments relates to a high resolution and thus enables an accurate monitoring of rail vehicles on the track.

According to at least one embodiment of the method the first event monitoring signal value is proportional to the sum of the energy emitted by the passing rail vehicle within the first measurement segment or the first event monitoring signal value is proportional to the average of the energy emitted by the passing rail vehicle within the first measurement segment. The backscattered signal is proportional to the energy emitted at the respective position of a measurement segment. Since the first event monitoring signal value is proportional to the sum of the energy emitted by the passing rail vehicle within the first measurement segment, the first event monitoring signal value is a measure for the energy emitted by the respective rail vehicle. This can mean, the first event monitoring signal value is the sum of the monitoring signal values that are detected during the passage of a rail vehicle over the position of the first measurement segment. It is further possible that the first event monitoring signal value is proportional to the sum of the monitoring signal values that are detected during the passage of a rail vehicle over the position of the first measurement segment. Since the distributed acoustic sensor is not in direct contact with the rail but arranged spaced apart, the first event monitoring signal value is only proportional to the energy emitted by the passing rail vehicle but does not provide the exact value of the energy. It is further possible that the first event monitoring signal value is proportional to the average of the energy emitted by the passing rail vehicle within the first measurement segment. This means, the first event monitoring signal value is the average of the monitoring signal values that are detected during the passage of a rail vehicle over the position of the first measurement segment. It is advantageous to detect a measure of the energy emitted by a passing rail vehicle, since this energy can be changed for the situation of a defect or other changes at the rail vehicle or at the rails. Therefore, by analyzing the monitoring signal values, defects or other changes at rail vehicles or the rails can be detected. The detection of defects and other changes is necessary in order to fulfill safety requirements.

According to at least one embodiment of the method the second event monitoring signal value is proportional to the sum of the energy emitted by the passing rail vehicle within the second measurement segment or the second event monitoring signal value is proportional to the average of the energy emitted by the passing rail vehicle within the second measurement segment. It is further possible that for each measurement segment the respective event monitoring signal value is proportional to the sum of the energy emitted by the passing rail vehicle within the respective measurement segment or that the respective event monitoring signal value is proportional to the average of the energy emitted by the passing rail vehicle within the respective measurement segment.

According to at least one embodiment of the method the relative difference relates to the respective ratio. This means, the term relative difference between two values relates to the ratio between these two values. It is further possible that the term relative difference between two values relates to a percentage difference between these two values. Comparing only relative differences has the advantage that the difference in velocity or weight of rail vehicles is not taken into account. Therefore, deviations from normal operation can be detected more easily.

According to at least one embodiment of the method each monitoring signal value is a signal-to-noise ratio. The monitoring signal values give the amplitude of the monitoring signal for the respective measurement segment. For the further calculation and analysis the signal-to-noise ratio of these amplitudes are employed as the monitoring signal values. It is further possible to only employ a specified range of frequencies of the monitoring signal values. These two possibilities enable to filter out the noise out of the monitoring signal values. In this way, the accuracy of monitoring is improved.

According to at least one embodiment of the method the monitoring signal values relate to the amplitude of the respective detected monitoring signal. This means, monitoring signal value gives the amplitude of the monitoring signal for the respective measurement segment.

According to at least one embodiment of the method, the method further comprises determining the velocity of a rail vehicle passing over the position of the first measurement segment and normalizing the first event monitoring signal value with respect to the velocity of the rail vehicle. The velocity of a rail vehicle influences the amplitude of the backscattered signal and thus of the monitoring signal. The higher the velocity of a rail vehicle, the higher is the amplitude. The velocity of a rail vehicle on the track can be determined from the monitoring signal. For example, monitoring signals at different times can be compared and from the difference in the location of the rail vehicle its velocity can be determined. It is further possible to employ other sensors for determining the velocity of a rail vehicle, for example wheel sensors. The first event monitoring signal value can be normalized with respect to a predefined velocity. This means, for velocities above and below the predefined velocity the first event monitoring signal value can be multiplied with a normalization factor. With the normalization the impact of the velocity of the rail vehicle on the amplitude of the monitoring signal is removed. After the normalization, first event monitoring signal values for different measurement segments or for different rail vehicles can be compared with each other even if the rail vehicle moves with different velocities at the different measurement segments or if the different rail vehicles move with different velocities. Since the velocity of the rail vehicles has no influence anymore on the monitoring signal values, the overall accuracy of monitoring is improved.

According to at least one embodiment of the method, the method further comprises determining the velocity of a rail vehicle passing over the position of the second measurement segment and normalizing the second event monitoring signal value with respect to the velocity of the rail vehicle. It is further possible that for each measurement segment the method further comprises determining the velocity of a vehicle passing over the position of the respective measurement segment and normalizing the respective event monitoring signal value with respect to the velocity of the rail vehicle.

According to at least one embodiment of the method for determining the relative values from previous passages of rail vehicles the position on the track of these rail vehicles is determined by employing further information about the movement of the rail vehicles. For determining the initial monitoring signal values it is necessary to know the location of moving rail vehicles and on which track they are moving. Only in this way detected initial monitoring signal values can be related to the movement of a rail vehicle on the correct track. The further information about the movement of rail vehicles can be obtained from an analysis of the monitoring signals. For example the shape of the monitoring signals during the movement of a rail vehicle can be analyzed so that it can be determined for which measurement segments the monitoring signal relates to the presence of a rail vehicle. It is further possible to employ other sensors or information to determine the exact position of rail vehicles. For example, wheel sensors can be employed to determine on which track a rail vehicle is moving. As the initial monitoring signal values are detected under conditions where the location of moving rail vehicles is known, the initial monitoring signal values can be employed to determine the fingerprint for a track.

According to at least one embodiment of the method a correlation is determined between the average relative value and the relative value. This means, the relative value is compared to the average relative value. It is possible, that a cross relation is determined between the average relative value and the relative value. It is further possible that a weighted correlation is determined between the average relative value and the relative value. The correlation between the average relative value and the relative value can be determined for a plurality of measurement segments of the distributed acoustic sensor. This means, the relative value is compared to the fingerprint of the track. The correlation can be determined between different relative values and the fingerprint of the respective track. In case of a high correlation the rail vehicle is moving on the respective track. In case of a small correlation the rail vehicle might be moving on another track or a defect may be present on the rail or the rail vehicle. In this way, it is possible to determine if a rail vehicle moves on a certain track. In rail vehicle monitoring it is important to know on which track a rail vehicle is moving in order to continuously follow the movement of each rail vehicle. Furthermore, in case of a defect or change on a rail it is necessary to know on which track the defect or change is located.

According to at least one embodiment of the method a first correlation between the average relative value and the relative value is determined and wherein a second correlation between an average relative value of another track and the relative value is determined. The first correlation and the second correlation can each be a cross correlation. It is further possible that the first correlation and the second correlation are each a weighted correlation. The first correlation and the second correlation can be determined for a plurality of measurement segments of the distributed acoustic sensor. If a rail vehicle is moving on the track the first correlation is significantly higher than the second correlation. If the rail vehicle is moving on the other track the second correlation is significantly higher than the first correlation. This means, the first correlation refers to a first track and the second correlation refers to a second track. The first track and the second track are arranged next to each other. It is determined for which track the relative value is most correlated with the respective average relative value. This is also possible for more than two tracks arranged next to each other. In this way, it can be determined on which track a rail vehicle is moving.

According to at least one embodiment of the method, the method is carried out for a plurality of first measurement segments and a plurality of second measurement segments. In this way, the movement of rail vehicles on the track can be monitored over long distances, namely for a plurality of measurement segments. Therefore, the method enables to monitor railway traffic on the whole track.

According to at least one embodiment of the method after determining a relative value, one of the relative values determined from previous passages of rail vehicles is replaced by said relative value. This process enables an update of the relative values that are employed to determine the average relative value. The relative values are determined after one another. For the update, the relative value that was determined at first is replaced by the latest relative value. It is possible that each time a relative value is determined it replaces one of the relative values for that measurement segment. The total number of relative values from which the average relative value is determined can stay constant. Alternatively, it can be chosen manually which relative values replace older relative values. By replacing relative values small changes of the track are taken into account which can for example arise during different seasons or because of wear and tear of the rail. In this way, the accuracy of monitoring is improved.

According to at least one embodiment of the method the relative values contributing to the average relative value are multiplied by different weighting factors. The weighting factors can be the higher the more actual the respective relative value is. This is another way to update the relative values. In this way, the new relative values get more weight in the average relative value than older ones.

According to at least one embodiment of the method, the method further comprises replacing relative values for selectable measurement segments by relative values that were determined after the relative values that are to be replaced. This means, for selectable measurement segments the relative values can be replaced by updated relative values. This can for example be advantageous if the rail is repaired or replaced at one position. For this position all relative values can be replaced by relative values that were determined after the repair or replacement of the rail. After a repair or replacement of the rail the relative values can be different from the former relative values. In order to avoid misinterpretations it is advantageous to replace the older relative values by the relative values that are determined after the repair or replacement of the rail. For this purpose the relative values of the measurement segments around the repaired position are replaced. With this process of updating the relative values the accuracy of monitoring is improved.

Furthermore, a monitoring system for monitoring a railway track is provided. The monitoring system can preferably be employed in the methods described herein. This means all features disclosed for the method for monitoring a railway track are also disclosed for the monitoring system for monitoring a railway track and vice-versa.

In at least one embodiment of the monitoring system for monitoring a railway track, the monitoring system comprises an evaluation unit that is connected to a distributed acoustic sensor being arranged along the track. The evaluation unit can be configured to receive data from the distributed acoustic sensor. Furthermore, the evaluation unit can be configured to analyze data received from the distributed acoustic sensor.

The evaluation unit comprises a detection unit that is configured to receive monitoring signals that are detected by the distributed acoustic sensor, where each monitoring signal comprises a monitoring signal value for a first measurement segment of the distributed acoustic sensor and a monitoring signal value for a second measurement segment of the distributed acoustic sensor. The detection unit can be connected with an input of the evaluation unit.

The evaluation unit comprises an event unit that is configured to determine a first event monitoring signal value for the first measurement segment from the monitoring signal values that are detected during the passage of a rail vehicle over the position of the first measurement segment, and to determine a second event monitoring signal value for the second measurement segment from the monitoring signal values that are detected during the passage of a rail vehicle over the position of the second measurement segment. The event unit can be connected with the detection unit.

The evaluation unit comprises a comparator unit that is configured to determine a difference value where the difference value relates to the difference between an average relative value and a relative value, where the relative value is given by the relative difference between the first event monitoring signal value and the second event monitoring signal value, and the average relative value relates to an average value of relative values determined from previous passages of rail vehicles. The comparator unit can be connected with the event unit. The average relative value can be stored in a storage unit. The storage unit can be connected with the comparator unit.

By employing the method for monitoring a railway track with the monitoring system a monitoring with an improved accuracy is enabled.

The following description of figures may further illustrate and explain exemplary embodiments. Components that are functionally identical or have an identical effect are denoted by identical references. Identical or effectively identical components might be described only with respect to the figures where they occur first. Their description is not necessarily repeated in successive figures.

With FIG. 1 an exemplary embodiment of the method for monitoring a railway track is described.

Figure 1:
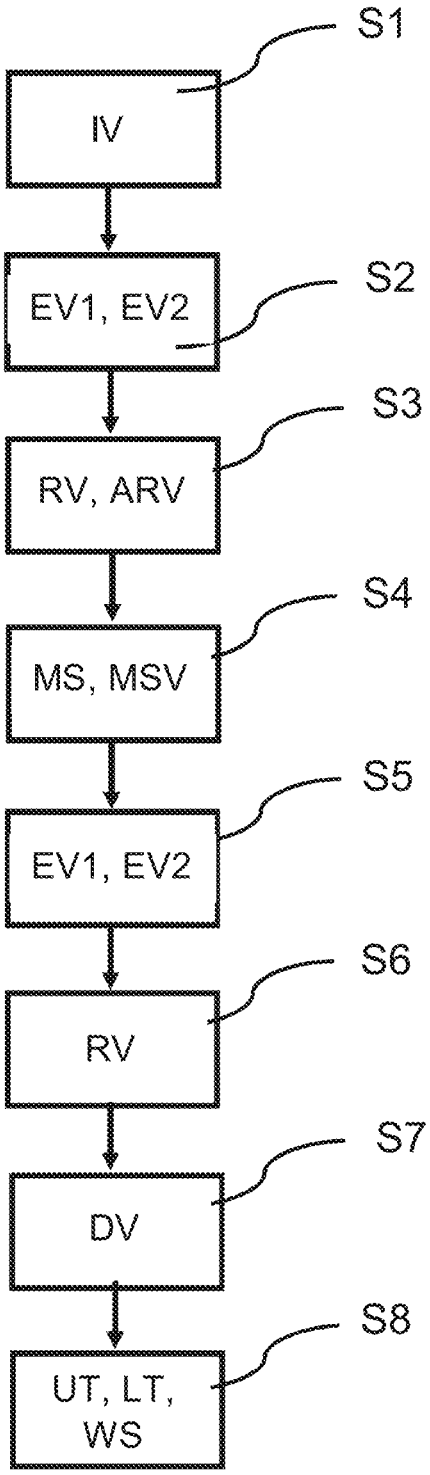

With FIG. 1 the steps of an exemplary embodiment of the method for monitoring a railway track 11 are described. The order of the steps can be different from the order provided here.

In a first step S1 initial monitoring signals are detected by a distributed acoustic sensor 10 that is arranged along the track 11. The initial monitoring signals are detected during the passage of rail vehicles on the track 11. The distributed acoustic sensor 10 is divided into a plurality of measurement segments 12, 22. Each measurement segment 12, 22 relates to a predefined distance along the distributed acoustic sensor 10. The initial monitoring signals are especially detected for a first measurement segment 12 and for a second measurement segment 22. Each initial monitoring signal comprises a plurality of initial monitoring signal values IV. Each initial monitoring signal comprises one initial monitoring signal value IV for each measurement segment 12, 22.

In a second step S2 first event monitoring signal values EV1 and second event monitoring signal values EV2 are determined. Each first event monitoring signal value EV1 is determined from the initial monitoring signal values IV that are detected during the passage of a rail vehicle over the position of the first measurement segment 12. For example, each first event monitoring signal value EV1 is proportional to the sum of the energy emitted by the passing rail vehicle within the first measurement segment 12 or the first event monitoring signal value EV1 is proportional to the average of the energy emitted by the passing rail vehicle within the first measurement segment 12. Each second event monitoring signal value EV2 is determined from the initial monitoring signal values IV that are detected during the passage of a rail vehicle over the position of the second measurement segment 22. For example, each second event monitoring signal value EV2 is proportional to the sum of the energy emitted by the passing rail vehicle within the second measurement segment 22 or the second event monitoring signal value EV2 is proportional to the average of the energy emitted by the passing rail vehicle within the second measurement segment 22.

For determining the initial monitoring signal values IV that are detected during the passage of one rail vehicle on the track 11 it is necessary to know where rail vehicles are moving on which track 11. The position along the track 11 of these rail vehicles can be determined by employing further information about the movement of the rail vehicles. These information are for example obtained by a further analysis of the monitoring signals MS. The step of detecting initial monitoring signal values IV and thus determining first and second event monitoring signal values EV1, Ev2 can be repeated several times. In this way, for each measurement segment 12, 22 a plurality of event monitoring signal values EV1, EV2 is obtained.

In a third step S3 relative values RV are determined. Each relative value RV relates to the relative difference between a first event monitoring signal value EV1 and a second event monitoring signal value EV2. The relative difference can be the respective ratio. From the relative values RV an average relative value ARV is determined. The average relative value ARV is an average value of the relative values RV. The average relative value ARV can be determined for each measurement segment 12, 22. The entirety of the average relative values ARV for one track 11 is referred to as the fingerprint of that track 11.

In a fourth step S4 monitoring signals MS are detected by the distributed acoustic sensor 10. Each monitoring signal MS comprises a monitoring signal value MSV for the first measurement segment 12 of the distributed acoustic sensor 10 and a monitoring signal value MSV for the second measurement segment 22 of the distributed acoustic sensor 10. Instead of the respective monitoring signal value MSV the signal-to-noise ratio of each monitoring signal value MSV can be employed in order to improve the accuracy of the method.

In a fifth step S5 a first event monitoring signal value EV1 for the first measurement segment 12 is determined from the monitoring signal values MSV that are detected during the passage of a rail vehicle over the position of the first measurement segment 12. Furthermore, a second event monitoring signal value EV2 for the second measurement segment 22 is determined from the monitoring signal values MSV that are detected during the passage of a rail vehicle over the position of the second measurement segment 22. For example, the first event monitoring signal value EV1 is proportional to the sum of the energy emitted by the passing rail vehicle within the first measurement segment 12 or the first event monitoring signal value EV1 is proportional to the average of the energy emitted by the passing rail vehicle within the first measurement segment 12. For example, each second event monitoring signal value EV2 is proportional to the sum of the energy emitted by the passing rail vehicle within the second measurement segment 22 or the second event monitoring signal value EV2 is proportional to the average of the energy emitted by the passing rail vehicle within the second measurement segment 22. This step can be repeated for a plurality of other measurement segments 12, 22. Each event monitoring signal value EV1, EV2 is proportional to the energy emitted by the respective passing rail vehicle within the respective measurement segment 12, 22.

In a sixth step S6 a relative value RV is determined. The relative value RV is given by the relative difference between the first event monitoring signal value EV1 and the second event monitoring signal value EV2 determined in the fifth step S5.

In a seventh step S7 a difference value DV is determined. The difference value DV relates to the difference between the average relative value ARV and the relative value RV. The average relative value ARV and the relative value RV are determined for the same two measurement segments 12, 22.

In an optional eighth step S8 the difference value DV is compared to an upper threshold value UT. The upper threshold value UT is given by the product of the variance of the average relative value ARV and a k-value, and it is determined if the difference value DV exceeds the upper threshold value UT. Furthermore, the difference value DV is compared to a lower threshold value LT. The lower threshold value LT is given by the product of the variance of the average relative value ARV and an l-value, and it is determined if the difference value DV is below the lower threshold value LT. In this way, deviations that are larger than typical deviations can be detected. If the difference value DV exceeds the upper threshold value UT or is below the lower threshold value LT a warning signal WS can be provided.

The accuracy of the method can further be improved by determining the velocity of a rail vehicle passing over the position of the first measurement segment 12 and normalizing the first event monitoring signal value EV1 with respect to the velocity of the rail vehicle. Moreover, the velocity of a rail vehicle passing over the position of the second measurement segment 22 can be determined and the second event monitoring signal value EV2 can be normalized with respect to the velocity of the rail vehicle.

In an optional further step of the method a correlation is determined between the average relative value ARV and the relative value RV. If several tracks 11 are arranged next to each other, for each track 11 a correlation between the average relative value ARV and the relative value RV is determined.

In order to further improve the accuracy of the method it is possible after determining a relative value RV to replace one of the relative values RV determined from previous passages of rail vehicles by said relative value RV. This update of the relative values RV can be done continuously. This means, for each measurement segment 12, 22 and for each determined relative value RV, the current relative value RV replaces one relative value RV for the respective measurement segment 12, 22. For example, in each case the oldest relative value RV is replaced. The total number of relative values RV can stay constant. It is further possible to replace relative values RV for selectable measurement segments 12, 22 by relative values RV that were determined after the relative values RV that are to be replaced. This manual replacement can be advantageous if a rail was repaired or a part of a rail was replaced. Therefore, the accuracy of the method is improved by replacing the relative values RV by relative values RV that were determined after the repair or replacement of the rail.

The method can be carried out for a plurality of first measurement segments 12 and a plurality of second measurement segments 22.

Figure 2:
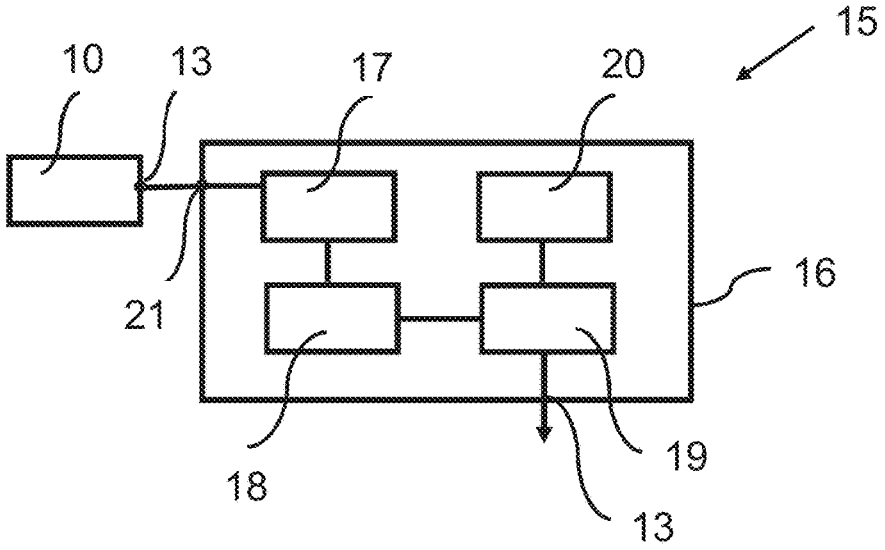
FIGS. 2, 3 and 4 show exemplary embodiments of the monitoring system for monitoring a railway track.

In FIG. 2 an exemplary embodiment of a monitoring system 15 for monitoring a railway track 11 is shown. The monitoring system 15 comprises an evaluation unit 16 that is connected to a distributed acoustic sensor 10 being arranged along the track 11. The evaluation unit 16 comprises an input 21 which is connected with an output 13 of the distributed acoustic sensor 10. The evaluation unit 16 comprises a detection unit 17 that is configured to receive monitoring signals MS that are detected by the distributed acoustic sensor 10, where each monitoring signal MS comprises a monitoring signal value MSV for a first measurement segment 12 of the distributed acoustic sensor 10 and a monitoring signal value MSV for a second measurement segment 22 of the distributed acoustic sensor 10. The evaluation unit 16 further comprises an event unit 18 that is configured to determine a first event monitoring signal value EV1 for the first measurement segment 12 from the monitoring signal values MSV that are detected during the passage of a rail vehicle over the position of the first measurement segment 12, and to determine a second event monitoring signal value EV2 for the second measurement segment 22 from the monitoring signal values MSV that are detected during the passage of a rail vehicle over the position of the second measurement segment 22. The detection unit 17 is connected with the event unit 18. The evaluation unit 16 further comprises a comparator unit 19 that is configured to determine a difference value DV where the difference value DV relates to the difference between an average relative value ARV and a relative value RV, where the relative value RV is given by the relative difference between the first event monitoring signal value EV1 and the second event monitoring signal value EV2. The comparator unit 19 is connected with the event unit 18. Furthermore, the comparator unit 19 is connected with a storage unit 20 where the average relative values ARV are stored. The comparator unit 19 is connected with an output 13 of the evaluation unit 16 where a warning signal WS can be provided. The monitoring system 15 can comprise the distributed acoustic sensor 10.

Figure 3:
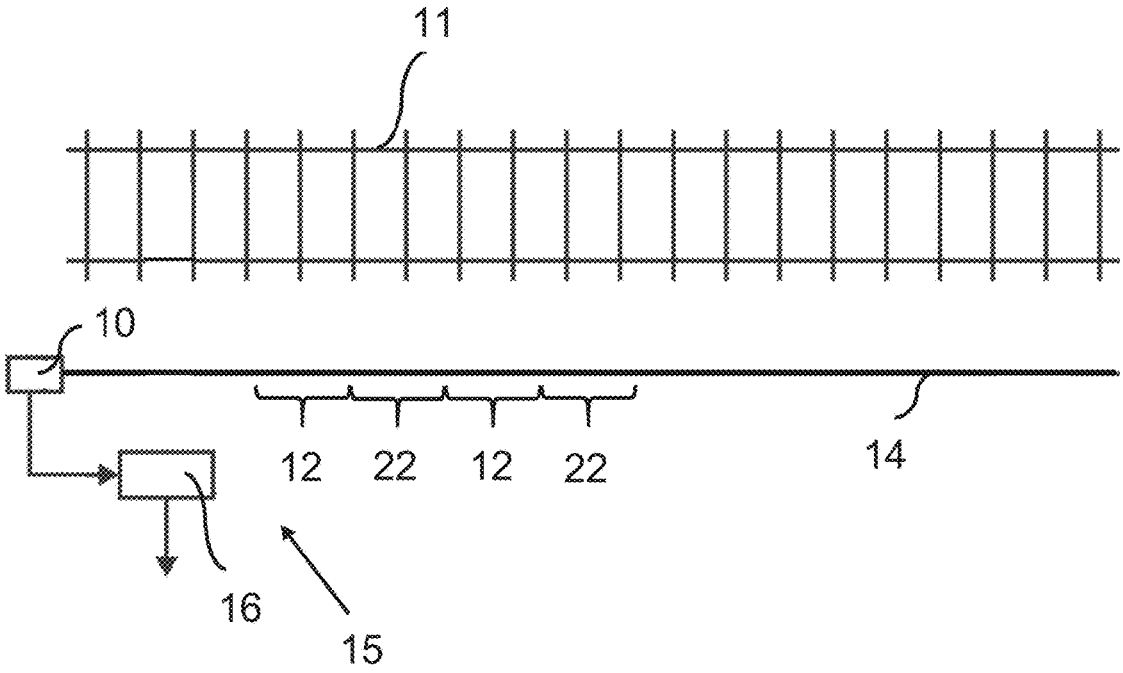

In FIG. 3 the embodiment of the monitoring system 15 is shown together with the distributed acoustic sensor 10 and a railway track 11. The evaluation unit 16 of the monitoring system 15 is connected with the distributed acoustic sensor 10. The distributed acoustic sensor 10 comprises an optical fibre 14 that is arranged along the track 11. Therefore, the monitoring signals MS are backscattered signals of an input signal IN which is provided to the optical fibre 14.

The distributed acoustic sensor 10 is divided into a plurality of measurement segments 12, 22. As an example four measurement segments 12, 22 are shown. Each measurement segment 12, 22 relates to a predefined length along the optical fibre 14 of the distributed acoustic sensor 10.

Figure 4:
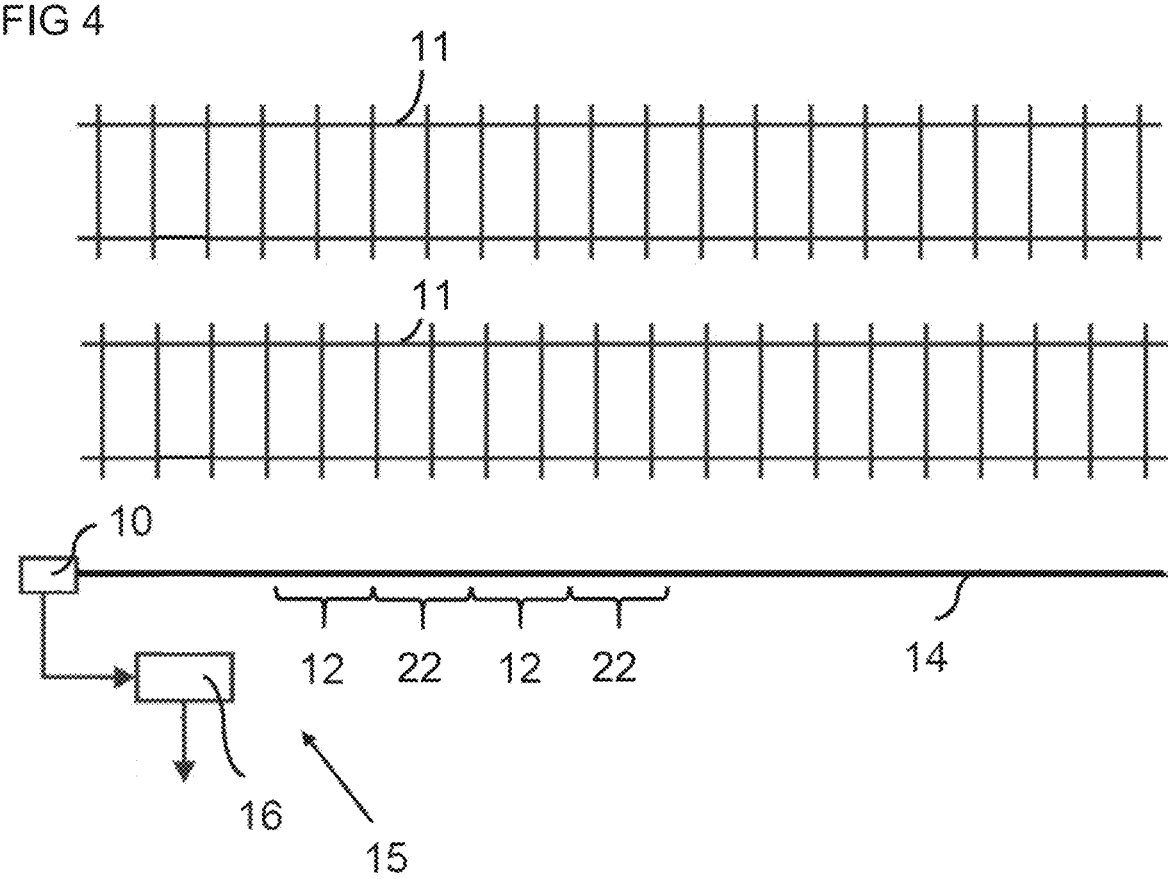

In FIG. 4 another exemplary embodiment of the monitoring system 15 is shown. The only difference to the embodiment shown in FIG. 3 is, that two tracks 11 are arranged next to each other. By employing the method described herein, it is possible to determine on which of the tracks 11 a rail vehicle is moving.

Figure 5:
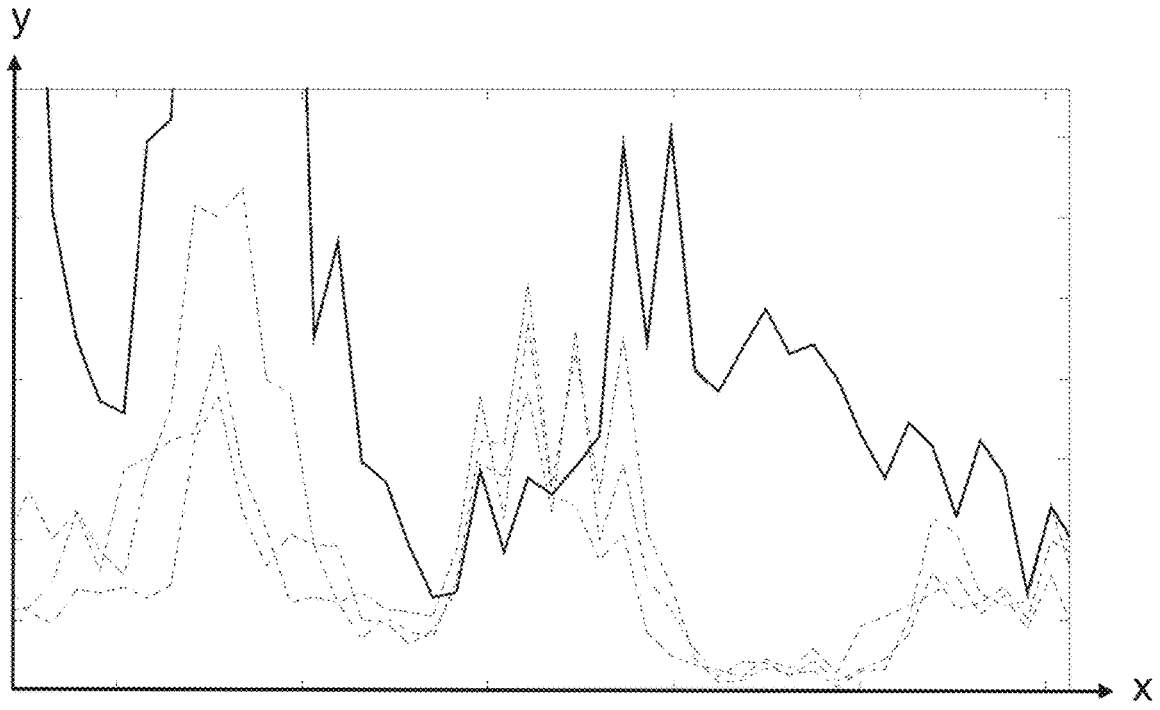
FIGS. 5 and 6 show exemplary signals employed in the method for monitoring a railway track.

FIG. 5 shows average relative values ARV for one railway track 11. On the x-axis the distance along the track 11 is plotted in arbitrary units and on the y-axis the amplitude is plotted in arbitrary units. The solid line shows average relative values ARV plotted at their positions along the track 11. This means, this line is the fingerprint of the track 11. The dashed lines are relative values RV that are detected after the fingerprint was determined. For most of the measurement segments 12, 22 the relative values RV lie within the range of the average relative values ARV. However, for a few measurement segments 12, 22 the relative values RV are higher than the average relative values AV. A defect or a change of the rail at this position can be the reason for the increased relative values RV.

Figure 6:
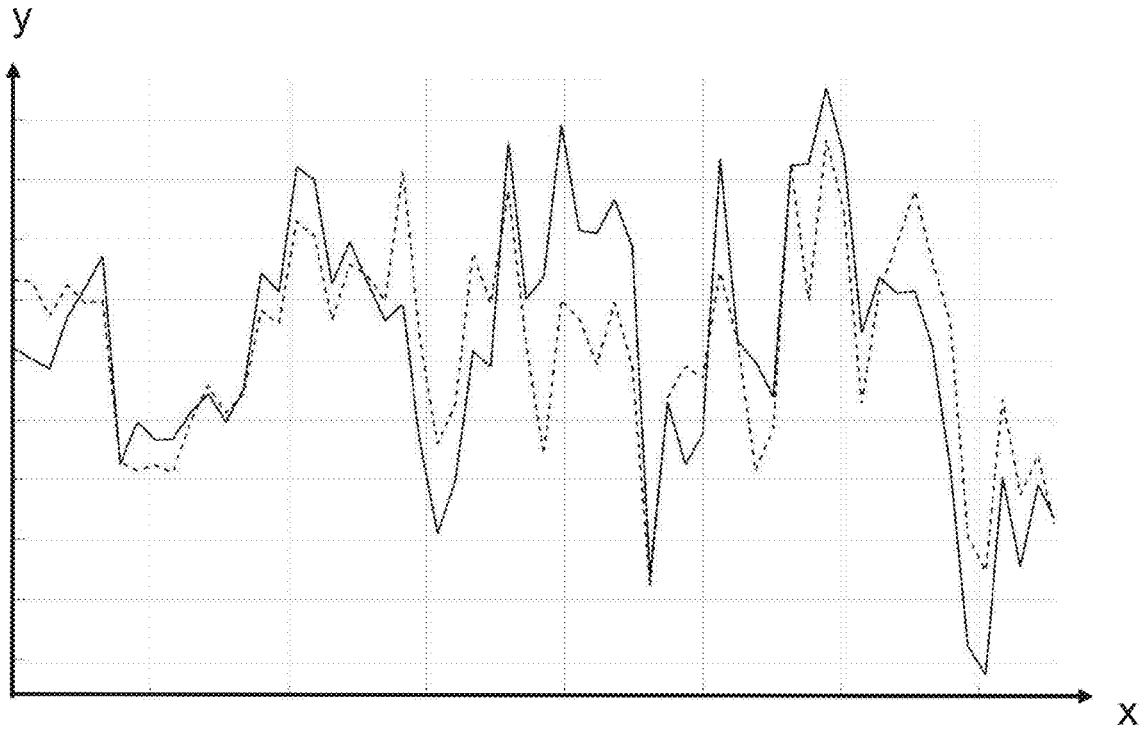

FIG. 6 shows average relative values ARV for two railway tracks 11. On the x-axis the distance along the tracks 11 is plotted in arbitrary units and on the y-axis the amplitude is plotted in arbitrary units. The solid line shows the average relative values ARV for a first track 11. The dashed line shows the average relative values ARV for a second track 11. It can be seen that the average relative values ARV significantly differ for the two tracks 11. Therefore, by employing the method described herein it is possible to distinguish on which of the tracks 11 a rail vehicle is moving.

REFERENCE NUMERALS

10: distributed acoustic sensor
11: track
12: first measurement segment

13: output
14: optical fibre
15: monitoring system
16: evaluation unit
17: detection unit
18: event unit
19: comparator unit
20: storage unit
21: input
22: second measurement segment
ARV: average relative value
DV: difference value
EV1: first event monitoring signal value
EV2: second event monitoring signal value
IN: input signal
IV: initial monitoring signal value
MS: monitoring signal
MSV: monitoring signal value
RV: relative value
UT: upper threshold value
LT: lower threshold value
WS: warning signal
S1-S8: steps

The invention claimed is:

1. A method for monitoring a railway track, the method comprising:

detecting monitoring signals by a distributed acoustic sensor being arranged along the railway track, where each monitoring signal comprises a monitoring signal value for a first measurement segment of the distributed acoustic sensor and a monitoring signal value for a second measurement segment of the distributed acoustic sensor;

determining a first event monitoring signal value for the first measurement segment from the monitoring signal values that are detected during a passage of a rail vehicle over a position of the first measurement segment;

determining a second event monitoring signal value for the second measurement segment from the monitoring signal values that are detected during the passage of the rail vehicle over a position of the second measurement segment; and determining a difference value where the difference value relates to a difference between an average relative value and a relative value, where the relative value is given by a relative difference between the first event monitoring signal value and the second event monitoring signal value, wherein the average relative value relates to an average value of relative values determined from previous passages of rail vehicles.

2. The method for monitoring a railway track according to claim 1, wherein the distributed acoustic sensor comprises an optical fiber arranged along the railway track and the monitoring signals are backscattered signals of an input signal which is provided to the optical fiber.

3. The method for monitoring a railway track according to claim 1, wherein an upper threshold value is given by a product of a variance or standard deviation of the average relative value and a k-value, and it is determined if the difference value exceeds the upper threshold value.

4. The method for monitoring a railway track according to claim 1, wherein a lower threshold value is given by a product of a variance or standard deviation of the average relative value and an l-value, and it is determined if the difference value is below the lower threshold value.

5. The method for monitoring a railway track according to claim 1, wherein the first measurement segment and the second measurement segment each relate to a predefined distance along the distributed acoustic sensor.

6. The method for monitoring a railway track according to claim 1, wherein the first event monitoring signal value is proportional to a sum of energy emitted by the rail vehicle passing within the first measurement segment or the first event monitoring signal value is proportional to an average of the energy emitted by the rail vehicle passing within the first measurement segment.

7. The method for monitoring a railway track according to claim 1, wherein the relative difference relates to a respective ratio.

8. The method for monitoring a railway track according to claim 1, wherein each monitoring signal value is a signal-to-noise ratio.

9. The method for monitoring a railway track according to claim 1, wherein the method further comprises determining a velocity of the rail vehicle passing over the position of the first measurement segment and normalizing the first event monitoring signal value with respect to the velocity of the rail vehicle.

10. The method for monitoring a railway track according to claim 1, wherein for determining the relative values from the previous passages of the rail vehicles, a position on the railway track of the rail vehicles is determined by employing further information about a movement of the rail vehicles.

11. The method for monitoring a railway track according to claim 1, wherein a correlation is determined between the average relative value and the relative value.

12. The method for monitoring a railway track according to claim 1, wherein a first correlation between the average relative value and the relative value is determined and wherein a second correlation between an average relative value of another track and the relative value is determined.

13. The method for monitoring a railway track according to claim 1, wherein the method is carried out for a plurality of first measurement segments and a plurality of second measurement segments.

14. The method for monitoring a railway track according to claim 1, wherein after determining the relative value, one of the relative values determined from the previous passages of the rail vehicles is replaced by the relative value.

15. A monitoring system for monitoring a railway track, the monitoring system comprising:

an evaluation unit that is connected to a distributed acoustic sensor being arranged along the railway track, wherein the evaluation unit comprises a detection unit that is configured to receive monitoring signals that are detected by the distributed acoustic sensor, where each monitoring signal comprises a monitoring signal value for a first measurement segment of the distributed acoustic sensor and a monitoring signal value for a second measurement segment of the distributed acoustic sensor, the evaluation unit comprises an event unit that is configured to determine a first event monitoring signal value for the first measurement segment from the monitoring signal values that are detected during a passage of a rail vehicle over a position of the first measurement segment, and to determine a second event monitoring signal value for the second measurement segment from the monitoring signal values that are detected during the passage of the rail vehicle over a position of the second measurement segment, the evaluation unit comprises a comparator unit that is configured to determine a difference value where the difference value relates to a difference between an average relative value and a relative value, where the relative value is given by a relative difference between the first event monitoring signal value and the second event monitoring signal value, and the average relative value relates to an average value of relative values determined from previous passages of rail vehicles.

* * * * *